US006467875B1

(12) United States Patent
Koga et al.

(10) Patent No.: US 6,467,875 B1
(45) Date of Patent: Oct. 22, 2002

(54) INK-JET WATER-BASED INK SET AND INK-JET RECORDING METHOD

(75) Inventors: Narumi Koga, Nagoya (JP); Kazuma Goto, Nagoya (JP); Naomichi Kobayashi, Nagoya (JP); Michiko Aoyama, Nagoya (JP); Shunichi Higashiyama, Yotsukaichi (JP); Masaya Fujioka, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/058,132

(22) Filed: Jan. 29, 2002

(30) Foreign Application Priority Data

Jan. 30, 2001 (JP) ..... 2001-021771

(51) Int. Cl.[7] ..... B41J 2/21; B41J 2/19
(52) U.S. Cl. ..... 347/43; 347/92
(58) Field of Search ..... 347/43, 179, 100, 347/86, 92, 96; 106/31.29, 31.31

(56) References Cited

U.S. PATENT DOCUMENTS 5,409,530 A * 4/1995 Kanbayashi et al. ..... 106/31.29
5,476,540 A 12/1995 Shields et al.
5,847,730 A * 12/1998 Miyashita ..... 347/45
6,290,978 B2 * 9/2001 Mak et al. ..... 424/401

FOREIGN PATENT DOCUMENTS

| | | |
|---|---|---|
| JP | A 55-65269 | 5/1980 |
| JP | A 62-101672 | 5/1987 |
| JP | A 8-209049 | 8/1996 |

* cited by examiner

*Primary Examiner*—Thinh Nguyen
(74) *Attorney, Agent, or Firm*—Oliff & Berridge, PLC

(57) ABSTRACT

An ink-jet water-based ink set comprises a black ink and a yellow ink. The black ink contains a black dye, barium hydroxide, and purified water. The yellow ink contains a yellow dye, ammonium chloride, and purified water. When these inks are used to produce liquid drops and to record images on a recording medium with the aid of an on-demand recording head, the barium hydroxide and ammonium chloride initiate an endothermic reaction, whereby color intermixing is reduced, and adequate spraying stability is obtained.

20 Claims, 1 Drawing Sheet

INK-JET WATER-BASED INK SET AND INK-JET RECORDING METHOD

BACKGROUND OF THE INVENTION

1. Field of the Invention

The present invention relates to an ink-jet water-based ink set for recording images by ink jetting with the aid of inks of at least two colors; to an ink-jet water-based ink set for recording images by color ink jetting with the aid of inks of at least four colors such as yellow, magenta, cyan, and black; and to an ink-jet recording method for recording images by spraying this ink set in fine liquid drops.

2. Description of the Related Art

With an ink-jet recording method, ink drops are formed and deposited partially or completely on paper or another recording material to record images by electrostatic attraction, by mechanically vibrating or displacing the ink with piezoelectric elements, by heating the ink to form gas bubbles and utilizing the resulting pressure, and other types of ink ejection.

In conventional practice, the inks for such ink-jet recording methods include those obtained by dissolving or dispersing water-soluble dyes or pigments in solvent media composed of water or combinations of water and water-soluble organic solvents.

As ink-jet printers become more advanced and widespread, problems are encountered in terms of different colors blending (bleeding) together in adjacent areas and the print quality being adversely affected when color images are recorded, particularly on the copy paper or other types of plain paper used in offices and households. Such bleeding presents a particularly serious problem in the case of yellow and black inks because they have markedly different tones.

Using inks obtained by adding surfactants or other permeability-enhancing compounds to the ink base has been proposed in Japanese Patent Application Laid-Open No. 55-65269 as a means of addressing these problems. According to another method, disclosed in Japanese Patent Application Laid-Open No. 8-209049, a composition containing sodium alginate as a gel-forming seed is combined with a composition containing calcium cations as gelation initiators to prevent the compositions from mixing with each other as a result of gelation reactions. Another common method adopted in conventional practice for commercially available color ink-jet printers entails suppressing bleeding by mixing the ink with an alkyl ether of a polyhydric alcohol, such as diethylene glycol monobutyl ether, as a penetrant.

The above-described prior art has the following drawbacks, however. Adding surfactants or admixing polyhydric alcohol alkyl ethers is still not sufficiently effective in terms of bleeding suppression, and, furthermore, the enhanced ink penetration causes monochromatic images to blur and makes it more difficult to obtain sharply defined edges. Utilizing gelation reactions is disadvantageous in the sense that the choice of materials is severely limited because most coloring agents form insoluble salts with calcium cations.

In addition, bleeding and other print quality attributes depend greatly on the type of paper because the plain paper used in offices and households varies considerably in terms of fiber thickness or length, the type and amount of the filler (or sizing agent), and the like.

SUMMARY OF THE INVENTION

An object of the present invention, which was achieved in order to address the aforementioned problems of the prior art, is to provide an ink-jet water-based ink set that allows bleeding to be efficiently prevented when images are recorded on various types of plain paper. Another object of the present invention, is to provide an ink cartridge containing the ink-jet water-based ink set, and a recording method using the is the ink-jet water-based ink set.

According to a first aspect of the invention, an ink-jet water-based ink set used for an ink jetting recording apparatus is provided, which comprises:

- a first ink containing water, a first coloring agent and a first component; and
- a second ink containing water, a second coloring agent and a second component which causes an endothermic reaction when in contact with the first component.

According to a second aspect of the invention, an ink cartridge used for an ink jetting recording apparatus is provided, which comprises:

- a first compartment accommodating a first ink which contains water, a first coloring agent and a first component;
- a second compartment accommodating a second ink which contains water, a second coloring agent and a second component which causes an endothermic reaction when in contact with the first component.

According to a third aspect of the invention, an ink-jet recording method for recording images by ejecting an ink-jet water-based ink set onto a recording medium, is provided, which comprises:

- ejecting a first ink containing water, a first coloring agent and a first component onto the recording medium; and
- ejecting a second ink containing water, a second coloring agent and a second component onto the recording medium, the second component causing an endothermic reaction when in contact with the first component.

In the ink-jet water-based ink set, the cartridge or the recording method according to the invention, the first component may be barium hydroxide and the second component may be an ammonium salt. Ammonium hydroxide may be produced by the reaction of the barium hydroxide and the ammonium salt. The ammonium salt may be at least one salt selected from a group consisting of ammonium chloride, ammonium nitrate, and ammonium thiocyanate. The first coloring agent may be a black coloring agent and the second coloring agent may be a yellow coloring agent.

The ink set or the cartridge may include third and/or fourth ink, each of which includes a component which causes an endothermic reaction when in contact with the first component. In this case, the third ink may contain a magenta coloring agent, and the fourth ink may contain a cyan coloring agent. A solid deposit may be formed upon the endothermic reaction of the first component with the second component. The first ink may contain 0.01–10 wt % of the first component and the second ink may contain 0.01–10 wt % of the second component.

DETAILED DESCRIPTION OF THE PREFERRED EMBODIMENT

Figure 1:
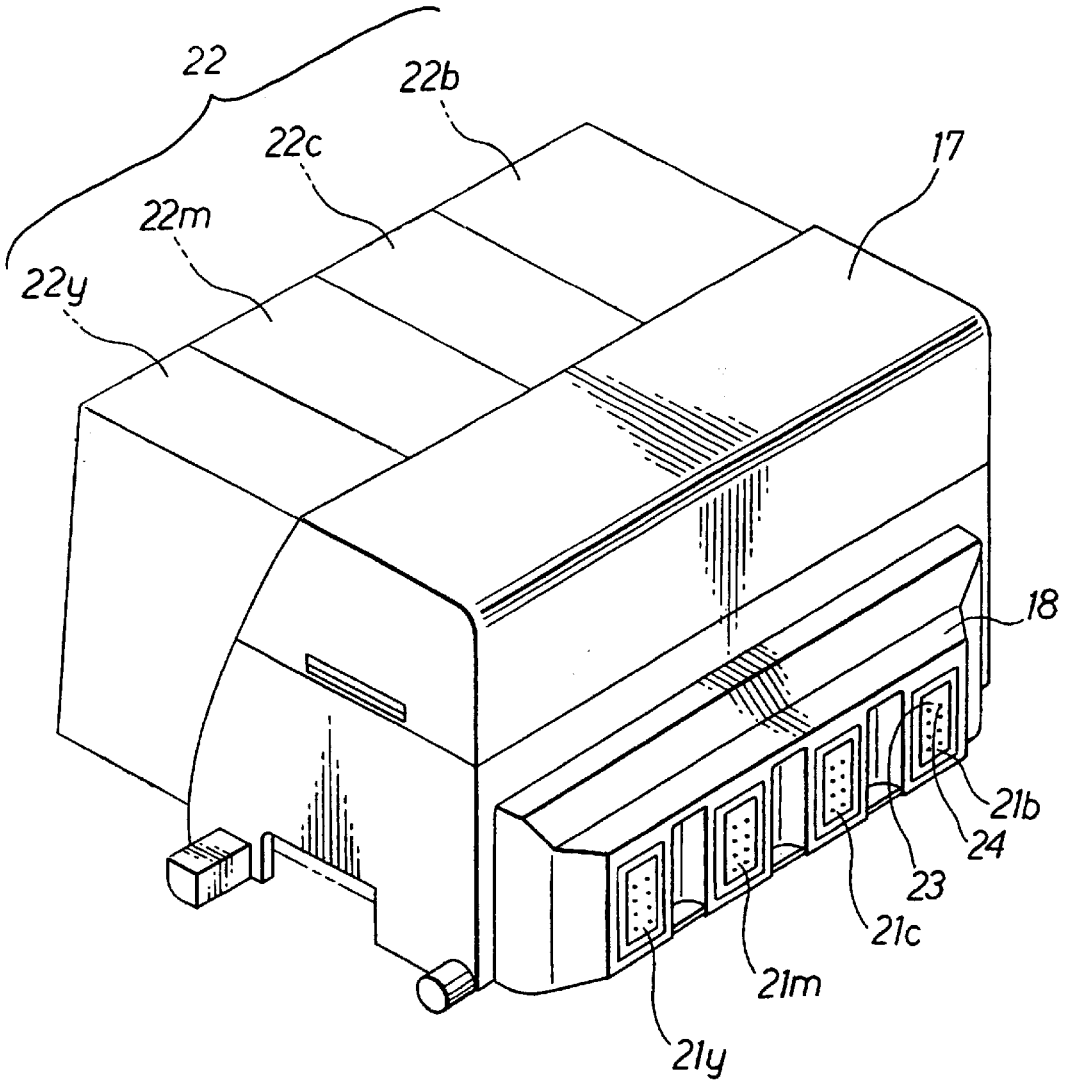
FIG. 1 shows an ink jet head which ejects four color inks and is provided with a color ink cartridge in accordance with the invention.

Embodiments of the present invention will now be described. In principle, the water-based ink set according to the present invention is similar to a conventional water-based ink commonly used in ink-jet applications in that this ink set comprises water, a water-soluble organic solvent, and a coloring agent. The ink set, however, is characterized in that components which are capable of initiating an endothermic reaction, when at least two types of ink having different colors come into contact with each other, are added in addition to the basic components.

The term "ink set" means a combination of two or more inks which have different colors. The ink set is typically used in an ink jet printer which ejects different color inks onto a recording sheet. In such an ink jet printer, the ink set is accommodated in an ink cartridge which has several compartments or rooms corresponding to the different color inks. The ink set is available as various forms, for example, as an ink cartridge for replacement, a package separately containing the respective inks, or a set of packages each containing a different ink.

The concept of the endothermic reaction includes not only so called endothermic reaction, but also a reaction system in which a volatile component is produced by the reaction and an endoergic is caused in the system when the volatile component is volatilized.

Following is a description of the mechanism that allows such a reaction to be effective for preventing bleeding during ink-jet recording. Bringing black and color inks into contact with each other on the surface of recording paper initiates an endothermic reaction and at the same time causes volatile components to be volatilized as reaction products at the interface between the two types of ink, so the black and color inks absorb heat in the areas around the interface between the inks, reduce the temperature, and increase viscosity. As a result of this mechanism, ink intermixing is controlled because the two inks flow less readily along the interface between the inks. In addition, the volatile compounds resulting from the reaction vaporize and create a gaseous barrier at the interface between the inks, further reducing ink intermixing.

As a result of these two actions, black and color inks penetrate into the paper in areas outside the interface between the inks while prevented from mixing with each other. Fluidity is also controlled for the black and color inks in the areas around the interface, the inks are prevented from penetrating into the paper in the direction of the ink interface, in which gaseous barriers have been formed, and are allowed to selectively spread in the paper interior or in the direction opposite to the interface, making it possible to complete ink penetration and drying without any color mixing.

Anti-bleeding effect has been described based on the formation of volatile compounds as the reaction products. The bleeding effect is further enhanced in the case that precipitates form as the reaction products in addition to the volatile compounds, because the precipitates act as a barrier that prevents the colors from mixing with each other at the interface between the inks.

The following reactions are specific examples of the endothermic reaction initiated according to the present invention.

$$Ba(OH)_2+2NH_4Cl \rightarrow BaCl_2+2NH_4OH\uparrow \quad (1)$$

$$Ba(OH)_2+2NH_4NO_3 \rightarrow Ba(NO_3)_2+2NH_4OH\uparrow \quad (2)$$

$$Ba(OH)_2+2NH_4SCN \rightarrow Ba(SCN)_2+2NH_4OH\uparrow \quad (3)$$

The anti-bleeding effect based on the above-mentioned mechanism can be achieved by adding barium hydroxide to the black ink, and adding ammonium chloride, ammonium nitrate, or ammonium thiocyanate to the yellow, magenta, and cyan color inks, respectively.

The same effect can be obtained by adopting a reverse procedure and adding ammonium chloride, ammonium nitrate, or ammonium thiocyanate to the black ink, and adding barium hydroxide to the color inks.

The ammonium chloride, ammonium nitrate, and ammonium thiocyanate can be used singly or as mixtures.

In the particular case of the endothermic reaction exemplified above, a barium salt (barium chloride, barium nitrate, or barium thiocyanate) is deposited as a solid reaction product as a result of the reaction, further creating a solid precipitate barrier at the interface between the inks and providing an additional anti-bleeding effect. Because these barium salts are soluble in water, they gradually re-dissolve in the inks and have no effect on the ultimate print quality in any way despite depositing as solids immediately after the reaction. Even when the inks come into contact with each other inside the recording device (rather than on the paper surface) and initiate the aforementioned reaction, the nozzles are not clogged or otherwise affected and images can still be reliably recorded by ink jetting because the barium salts can re-dissolve in the inks.

The aforementioned endothermic reaction between barium hydroxide and an ammonium salt is thus particularly suitable for ink-jet recording. The above examples, however, should not be interpreted as limiting the scope of the present invention in any way, and components capable of initiating other endothermic reactions may also be added to the black and color inks as long as the effect of the present invention can be obtained.

Although the above examples were described with reference to color recording procedures that featured black and color inks, the present invention is not limited to such common color recording and can be adapted to applications in which inks of two or more colors are used, such as printing tickets composed of two or more colors, or recording multicolor images in other special applications.

Although the amounts in which the components that initiate an endothermic reaction in accordance with the above-described examples vary with the quantity of heat absorbed by the reaction, the vaporization or precipitation of the products, or the extent of such vaporization or precipitation, adding the components in an amount constituting about 0.01–10 wt % of the overall ink weight is preferred. This is because adding the endothermic reaction components in an amount of less than 0.01 wt % is believed to be ineffective in terms of bleeding prevention, whereas adding more than 10 wt % is believed to have an adverse effect on the storage stability or performance of the ink.

When the endothermic reaction proceeds in the sequence A+B→C+D, the ratio of the reaction component A added to the black ink and the reaction component B added to the color inks should preferably be substantially equal to the reaction equivalent of reaction components A and B, but this condition should not be construed as particularly limitation as long as the effect of the present invention is obtained.

The water used for the ink of the present invention should be deionized water (purified water). The water content should be set to 40 wt % or greater in relation to the overall ink weight in order to constantly maintain low ink viscosity level for unimpeded spraying.

The primary goal of the water-soluble organic solvent used for the ink of the present invention is to prevent the ink from depositing or exsiccating in the distal portion of the ink-jet head. A solvent having low volatility and good dispersion stability and pigment solubility should therefore be selected. Examples of such water-soluble organic solvents include polyethylene glycol and other polyalkylene glycols; ethylene glycol, propylene glycol, butylene glycol, diethylene glycol, dipropylene glycol, triethylene glycol, tripropylene glycol, 1,2,6-hexanetriol, thiodiglycol, 1,3-butanediol, 1,4-butanediol, 1,5-pentanediol, hexylene glycol and other alkylene glycols; and glycerine, 2-pyrrolidone, N-methyl-2-pyrrolidone, and other pyrrolidones. These water-soluble organic solvent can be used singly or as mixtures of two or more components.

The water-soluble organic solvents should be contained in the ink in an amount of 5–40 wt %, preferably 7–40 wt %, and more preferably 10–35 wt %, in relation to the overall ink amount. A content less than 5 wt % has inadequate wetting action and causes precipitation, exsiccation, and other drawbacks. A content greater than 40 wt % unnecessarily increases ink viscosity and makes the ink incapable of being discharged, impedes the drying of ink on the recording paper, and brings about other problems.

A water-soluble dye or pigment should be used as the coloring agent for the ink of the present invention. Examples of suitable water-soluble dyes include basic dyes, acid dyes, direct dyes, reactive dyes, and other cationic or anionic dyes. Specific examples include Basic Red (Color Index Nos. 1, 1:1, 2, 12, 13, 14, 18, 22, 27, 28, 29, 34, 38, 39, 46, 46:1, 67, 69, and 70), Basic Violet (Color Index Nos. 1, 2, 3, 4, 5, 7, 8, 10, 11, 11:1, 20, and 33), Basic Blue (Color Index Nos. 3, 6, 7, 9, 11, 12, 16, 17, 24, 26, 41, 47, and 66), Basic Green (Color Index Nos. 1, 4, and 5), Basic Yellow (Color Index Nos. 1, 11, 19, 21, 24, 25, 28, 29, 36, 45, 51, 67, and 73), Basic Orange (Color Index Nos. 14, 21, 22, and 32), Basic Brown (Color Index Nos. 1 and 4), Direct Black (Color Index Nos. 17, 19, 32, 51, 71, 108, 146, 154, and 168), Direct Blue (Color Index Nos. 6, 22, 25, 71, 86, 90, 106, and 199), Direct Red (Color Index Nos. 1, 4, 17, 28, 83, and 227), Direct Yellow (Color Index Nos. 12, 24, 26, 86, 98, 132, and 142), Direct Orange (Color Index Nos. 34, 39, 44, 46, and 60), Direct Violet (Color Index Nos. 47 and 48), Direct Brown (Color Index No. 109), Direct Green (Color Index No. 59), Acid Black (Color Index Nos. 2, 7, 24, 26, 31, 52, 63, 112, and 118), Acid Blue (Color Index Nos. 9, 22, 40, 59, 93, 102, 104, 113, 117, 120, 167, 229, and 234), Acid Red (Color Index Nos. 1, 6, 32, 37, 51, 52, 80, 85, 87, 92, 94, 115, 181, 256, 289, 315, and 317), Acid Yellow (Color Index Nos. 11, 17, 23, 25, 29, 42, 61, and 71), Acid Orange (Color Index Nos. 7 and 19), Acid Violet (Color Index No. 49), Food Black (Color Index Nos. 1 and 2), and Reactive Red (Color Index No. 180).

The aforementioned water-soluble dyes are particularly suitable for the present invention, but the present invention is not limited by these water-soluble dyes.

Many inorganic and organic pigments can be used in addition to carbon black. Examples include azo lake, insoluble azo pigments, condensed azo pigments, chelate azo pigments, and other azo pigments; phthalocyanine pigments, perylene and perinone pigments, anthraquinone pigments, quinacridone pigments, dioxane pigments, thioindigo pigments, isoindolinone pigments, quinophthalone pigments, and other polycyclic pigments; basic dye lake, acid dye lake, and other dye lakes; and nitro pigments, nitroso pigments, aniline black daylight fluorescent pigments, and other organic pigments, as well as titanium oxide, iron oxide, carbon black, and other inorganic pigments. It is also possible to use products (such as graft carbon) obtained by treating the surfaces of the aforementioned pigments with surfactants, polymer dispersants, or the like, or self-dispersing pigments obtained by the chemical introduction of functional groups into the pigment surface. These pigments are particularly suitable for the ink of the present invention, but the present invention is not limited by these pigments.

When a pigment that is not self-dispersing is used as a coloring agent, it can be dispersed by a conventional method together with appropriate dispersants, solvents, purified water, and, when needed, other additives.

The dispersants may be the polymer dispersants or surfactants used for pigment dispersion and described, for example, in Japanese Patent Application Laid-Open No. 62-101672. Examples of suitable polymer dispersants include gelatin, albumin, and other proteins; gum arabic, tragacanth gum, and other natural rubbers; saponin and other glycosides; methylcellulose, carboxycellulose, hydroxymethylcellulose, and other cellulose derivatives; ligninsulfonates, shellac, and other natural polymers; polyacrylates, salts of styrene-acrylic acid copolymers, salts of vinyl naphthalene-acrylic acid copolymers, salts of styrene-maleic acid copolymers, salts of vinyl naphthalene-maleic acid copolymers, sodium salts of β-naphthalenesulfonic acid formalin condensates, phosphates, and other anionic polymers; and polyvinyl alcohol, polyvinyl pyrrolidone, polyethylene glycol, and other nonionic polymers. Examples of suitable surfactants include higher alcohol sulfate ester salts, liquid fatty oil sulfate ester salts, alkyl allyl sulfonates, and other anionic surfactants; and polyoxyethylene alkyl ethers, polyoxyethylene alkyl esters, sorbitan alkyl esters, polyoxyethylene sorbitan alkyl esters, and other nonionic surfactants. One or more of these may be appropriately selected and used. Their consumption is commonly 1–20 wt % with respect to the overall ink amount.

Any known disperser can be used to disperse the aforementioned pigments. Examples include ball mills, roll mills, and sand mills. Of these, high-speed sand mills are particularly preferred.

The above-described water-soluble dyes and pigments can be used singly or as mixtures of two or more components, in which case desired colors unobtainable through single usage can be obtained. The content depends on the desired color or density and can vary within a wide range, but is usually 0.1–20 wt %, and preferably 0.3–15 wt %, in relation to the overall ink amount.

Described above was the basic structure of the ink used in the present invention. It is also possible, however, to obtain this structure by adding conventional penetrants, resin binders, dispersants, surfactants, viscosity regulators, surface tension regulators, pH regulators, dye solvents, preservatives/fungicides, and other optional additives.

Ethanol, isopropyl alcohol, and other monohydric alcohols may also be used in order to control ink drying and the penetration of ink into recording paper.

Thermal properties (such as specific heat, coefficient of thermal expansion, and thermal conductivity) can sometimes be adjusted to adapt the present invention to ink-jet systems in which ink is ejected by the action of thermal energy.

The ink used in accordance with the present invention and obtained in this manner, as well as the ink-jet recording method in which this ink is used, are devoid of the drawbacks of the prior art, afford adequate jetting stability, and are extremely effective in terms of bleeding prevention.

WORKING EXAMPLE

Specific working examples of the present invention will now be described. In the present specification and tables, "%" refers to percent by weight.

Working Example 1

| | |
|---|---|
| (Black Ink) | |
| Food Black 2 | 4% |
| Diethylene glycol | 20% |
| Barium hydroxide | 5% |
| Purified water | Balance |
| (Yellow Ink) | |
| Acid Yellow 23 | 1% |
| Glycerine | 25% |
| Ammonium chloride | 3% |
| Purified water | Balance |

The aforementioned materials were thoroughly mixed, stirred, and filtered through a 0.8 μm membrane filter, yielding the respective inks.

Satisfactory results were obtained when the test evaluations described below were conducted using a recording device that was capable of printing four colors and was equipped with on-demand multiple heads (ejection orifice diameter: 35 μm; resistance of heating resistor: 150Ω, drive voltage: 30 V; frequency: 2 kHz) in which the above-mentioned inks were used, liquid drops were produced by applying thermal energy to the ink inside the recording heads to record an image; and using a recording device that was capable of printing two or more colors and was equipped with on-demand multiple heads (ejection orifice diameter: 40 μm; drive voltage: 30 V; frequency: 10 kHz) in which liquid drops were produced by applying pressure (created by piezoelement vibration) to the ink inside the recording heads to record images.

Test Evaluation 1: Jetting Stability

The ink was continuously ejected for 24 hours in a 5° C. or 40° C. atmosphere at room temperature. Stable jetting was maintained throughout the process in both types of conditions.

Test Evaluation 2: Bleeding

Two-color images having adjacent black and yellow print areas were recorded on the plain paper described below to evaluate the extent of bleeding. It was found that color intermixing was substantially absent and that high-quality, clearly defined print images were obtained.

Plain paper: Xerox 4200 (by Xerox), Xerox L (by Xerox), Mitsubishi PPC Paper (by Mitsubishi Paper Mills), Speed Mouse (by Shiroki), Recycled Paper 100 (by Shiroki)

Working Example 2

| | |
|---|---|
| (Black Ink) | |
| Food Black 2 | 4% |
| Diethylene glycol | 20% |
| Barium hydroxide | 0.5% |
| Purified water | Balance |
| (Yellow Ink) | |
| Acid Yellow 23 | 1% |
| Glycerine | 25% |
| Ammonium chloride | 0.3% |
| Purified water | Balance |
| (Magenta Ink) | |
| Acid Red 52 | 1% |
| Glycerine | 20% |
| Diethylene glycol monobutyl ether | 5% |

-continued

| | |
|---|---|
| Purified water | Balance |
| (Cyan Ink) | |
| Acid Blue 9 | 1.5% |
| Glycerine | 20% |
| Diethylene glycol monobutyl ether | 5% |
| Purified water | Balance |

The aforementioned materials were thoroughly mixed, stirred, and filtered through a 0.8 μm membrane filter, yielding the respective inks.

Satisfactory results were obtained when the test evaluations described below were conducted using a recording device similar to the one used in working Example 1 and capable of printing four colors with the inks.

Test Evaluation 1: Jetting Stability

The ink was continuously ejected for 24 hours in a 5° C. or 40° C. atmosphere at room temperature, and stable jetting was maintained throughout the process in both types of conditions.

Test Evaluation 2: Bleeding

Color images having adjacent black and color print areas were recorded on the plain paper described below to evaluate the extent of bleeding. It was found that color intermixing was substantially absent between the yellow and black printed areas, and that high-quality images could generally be printed in the border areas between the yellow and black printed areas where the border between the colors is readily discernible.

Plain paper: Xerox 4200 (by Xerox), Xerox L (by Xerox), Mitsubishi PPC Paper (by Mitsubishi Paper Mills), Speed Mouse (by Shiroki), Recycled Paper 100 (by Shiroki)

Working Example 3

| | |
|---|---|
| (Black Ink) | |
| Food Black 2 | 4% |
| Diethylene glycol | 20% |
| Barium hydroxide | 0.5% |
| Purified water | Balance |
| (Yellow Ink) | |
| Acid Yellow 23 | 1% |
| Glycerine | 25% |
| Ammonium chloride | 0.3% |
| Purified water | Balance |
| (Magenta Ink) | |
| Acid Red 52 | 1% |
| Glycerine | 25% |
| Ammonium chloride | 0.3% |
| Purified water | Balance |
| (Cyan Ink) | |
| Acid Blue 9 | 1.5% |
| Glycerine | 25% |
| Ammonium chloride | 0.3% |
| Purified water | Balance |

The aforementioned materials were thoroughly mixed, stirred, and filtered through a 0.8 μm membrane filter, yielding the respective inks.

Satisfactory results were obtained when the test evaluations described below were conducted using a recording device that was used in Working Example 2 and was capable of printing four colors with the inks.

Test Evaluation 1: Jetting Stability

The ink was continuously ejected for 24 hours in a 5° C. or 40° C. atmosphere at room temperature, and stable jetting was maintained throughout the process in both types of conditions.

Test Evaluation 2: Bleeding

Color images having adjacent black and color print areas were recorded on the plain paper described below to evaluate the extent of bleeding. It was found that color intermixing was substantially absent and that high-quality images could be printed in all border areas.

Plain paper: Xerox 4200 (by Xerox), Xerox L (by Xerox), Mitsubishi PPC Paper (by Mitsubishi Paper Mills), Speed Mouse (by Shiroki), Recycled Paper 100 (by Shiroki)

Working Example 4

Ammonium nitrate was used in an amount of 7% instead of the 0.3% ammonium chloride used for the yellow, magenta, and cyan inks in Working Example 3, the amount of the barium hydroxide used for the black ink in Working Example 3 was changed from 0.5% to 5%, the same test evaluations as in Working Example 3 were performed, and each of the tests produced the same satisfactory results as those obtained in Working Example 3.

Working Example 5

Ammonium thiocyanate was used in an amount of 0.45% instead of the 0.3% ammonium chloride used for the yellow, magenta, and cyan inks in Working Example 3, these inks were combined with the black ink of Working Example 3, the same test evaluations as in Working Example 3 were performed, and each of the tests produced the same satisfactory results as those obtained in Working Example 3.

Working Example 6

Ammonium chloride was used in an amount of 0.5% instead of the 0.5% barium hydroxide used for the black ink in Working Example 3; barium hydroxide was used in an amount of 0.8% instead of the 0.3% ammonium chloride used for the yellow, magenta, and cyan inks in Working Example 3, the same test evaluations as in Working Example 3 were performed, and each of the tests produced the same satisfactory results as those obtained in Working Example 3.

Working Example 7

| | |
|---|---|
| (Black Ink) | |
| Direct Black 168 | 5% |
| 1,5-Pentanediol | 10% |
| Barium hydroxide | 0.25% |
| Purified water | Balance |
| (Yellow Ink) | |
| Direct Yellow 86 | 2% |
| Polyethylene glycol (molecular weight: 200) | 20% |
| Ammonium chloride | 0.1% |
| Ammonium nitrate | 0.1% |
| Purified water | Balance |
| (Magenta Ink) | |
| Direct Red 227 | |
| Polyethylene glycol (molecular weight: 200) | 20% |
| Ammonium chloride | 0.1% |
| Ammonium thiocyanate | 0.1% |
| Purified water | Balance |

-continued

| | |
|---|---|
| (Cyan Ink) | |
| Direct Blue 199 | 2% |
| Polyethylene glycol (molecular weight: 200) | 20% |
| Ammonium nitrate | 0.1% |
| Ammonium thiocyanate | 0.1% |
| Purified water | Balance |

The aforementioned materials were thoroughly mixed, stirred, and filtered through a 0.8 μm membrane filter, yielding the respective inks. The same test evaluations as in Working Example 3 were performed, and each of the tests produced the same satisfactory results as those obtained in Working Example 3.

Working Example 8

| | |
|---|---|
| (Black Ink) | |
| Self-dispersing carbon black (terminal carboxyl groups) | 5% |
| Glycerine | 15% |
| Barium hydroxide octahydrate | 0.5% |
| Purified water | Balance |

The aforementioned materials were thoroughly mixed, stirred, and filtered through a 0.8 μm membrane filter, yielding black ink. The black ink was combined with the yellow, magenta, and cyan inks of Working Example 7, respectively, the same test evaluations as in Working Example 3 were performed, and each of the tests produced the same satisfactory results as those obtained in Working Example 3.

Comparative Example 1

| | |
|---|---|
| (Black Ink) | |
| Food Black 2 | 4% |
| Diethylene glycol | 20% |
| Barium hydroxide | 5% |
| Purified water | Balance |
| (Yellow Ink) | |
| Acid Yellow 23 | 1% |
| Glycerine | 0% |
| Diethylene glycol monobutyl ether | 5% |
| Purified water | Balance |

The aforementioned materials were thoroughly mixed, stirred, and filtered through a 0.8 μm membrane filter, yielding inks, respectively. The same test evaluations as in Working Example 1 were performed, and while Test Evaluation 1 produced satisfactory results, Test Evaluation 2 produced results that were characterized by pronounced irregularities due to color intermixing and gave an overall impression of low print quality.

Comparative Example 2

| | |
|---|---|
| (Black Ink) | |
| Food Black 2 | 4% |
| Diethylene glycol | 20% |
| Barium hydroxide | 0.5% |
| Purified water | Balance |
| (Yellow Ink) | |
| Acid Yellow 23 | 1% |
| Glycerine | 20% |
| Diethylene glycol monobutyl ether | 5% |
| Purified water | Balance |
| (Magenta Ink) | |
| Acid Red 52 | 1% |
| Glycerine | 20% |
| Diethylene glycol monobutyl ether | 5% |
| Purified water | Balance |
| (Cyan Ink) | |
| Acid Blue 9 | 1.5% |
| Glycerine | 20% |
| Diethylene glycol monobutyl ether | 5% |
| Purified water | Balance |

The aforementioned materials were thoroughly mixed, stirred, and filtered through a 0.8-$\mu$m membrane filter, yielding the respective inks. The same test evaluations as in Working Example 3 were performed, and while Test Evaluation 1 produced satisfactory results, Test Evaluation 2 produced results that were characterized by the presence of pronounced irregularities due to color intermixing and gave an overall impression of low print quality, particularly in the border regions between black and yellow print images.

Comparative Example 3

Ammonium chloride was used in an amount of 0.5% instead of the 0.5% barium hydroxide used for the black ink in Comparative Example 2, this ink was combined with the yellow, magenta, and cyan inks of Comparative Example 2, and the same test evaluations as in Working Example 3 were performed. While Test Evaluation 1 produced satisfactory results, Test Evaluation 2 produced results that were characterized by the presence of pronounced irregularities due to color intermixing and gave an overall impression of low print quality in the border regions.

Comparative Example 4

Diethylene glycol monobutyl ether was used in an amount of 5% instead of the 0.5% barium hydroxide used for the black ink in Comparative Example 2, the amount of the diethylene glycol used for the black ink was changed from 20% to 15%, this ink was combined with the yellow, magenta, and cyan inks of Comparative Example 2, and the same test evaluations as in Working Example 3 were performed. While Test Evaluation 1 produced satisfactory results, Test Evaluation 2 produced results that were characterized by the presence of pronounced irregularities due to color intermixing and gave an overall impression of inadequate print quality in the border regions.

Working Example 9

The amounts of the ammonium chloride and glycerine used for the yellow, magenta, and cyan inks of Working Example 3 were changed from 0.3% to 12% and from 25% to 15%, respectively; these inks were combined with the black ink of Working Example 3; and the same test evaluations as in Working Example 3 were performed. In Test Evaluation 1, unstable spraying of the color inks was observed, and the spraying instability was particularly pronounced at 5° C. In Test Evaluation 2, the intermixing of colors in the border areas was substantially undetectable apart from the presence of print irregularities due to unstable spraying.

TABLE 1

| | Example 1 | | Example 2 | | | |
|---|---|---|---|---|---|---|
| | BK | Y | BK | Y | M | C |
| Food Black 2 | 4% | | 4% | | | |
| Direct Black 168 | | | | | | |
| Self-dispersing carbon black (terminal carboxyl groups) | | | | | | |
| Acid Yellow 23 | | 1% | | 1% | | |
| Direct Yellow 86 | | | | | | |
| Acid Red 52 | | | | | 1% | |
| Direct Red 227 | | | | | | |
| Acid Blue 9 | | | | | | 1.5% |
| Direct Blue 199 | | | | | | |
| Diethylene glycol | 20% | | 20% | | | |
| Glycerine | | 25% | | 25% | 20% | 20% |
| 1,5-Pentanediol | | | | | | |
| Polyethylene glycol (molecular weight: 200) | | | | | | |
| Diethylene glycol monobutyl ether | | | | | 5% | 5% |
| Barium hydroxide | 5% | | 0.5% | | | |
| Barium hydroxide octahydrate | | | | | | |
| Ammonium chloride | | 3% | | 0.3% | | |
| Ammonium nitrate | | | | | | |
| Ammonium thiocyanate | | | | | | |
| Purified water | Bal. | Bal. | Bal. | Bal. | Bal. | Bal. |
| Total | 100% | 100% | 100% | 100% | 100% | 100% |
| Test Evaluation 1 | Good | | | Good | | |
| Test Evaluation 2 | Excellent | | | Good | | |

TABLE 2

| | Example 3 | | | | Example 4 | | | |
|---|---|---|---|---|---|---|---|---|
| | BK | Y | M | C | BK | Y | M | C |
| Food Black 2 | 4% | | | | 4% | | | |
| Direct Black 168 | | | | | | | | |
| Self-dispersing carbon black (terminal carboxyl groups) | | | | | | | | |
| Acid Yellow 23 | | 1% | | | | 1% | | |
| Direct Yellow 86 | | | | | | | | |
| Acid Red 52 | | | 1% | | | | 1% | |
| Direct Red 227 | | | | | | | | |
| Acid Blue 9 | | | | 1.5% | | | | 1.5% |
| Direct Blue 199 | | | | | | | | |
| Diethylene glycol | 20% | | | | 20% | | | |
| Glycerine | | 25% | 25% | 25% | | 25% | 25% | 25% |
| 1,5-Pentanediol | | | | | | | | |
| Polyethylene glycol (molecular weight: 200) | | | | | | | | |
| Diethylene glycol monobutyl ether | | | | | | | | |
| Barium hydroxide | 0.5% | | | | 5% | | | |
| Barium hydroxide octahydrate | | | | | | | | |
| Ammonium chloride | | 0.3% | 0.3% | 0.3% | | | | |
| Ammonium nitrate | | | | | | 7% | 7% | 7% |
| Ammonium thio-cyanate | | | | | | | | |
| Purified water | Bal. | Bal. | Bal. | Bal. | Bal. | Bal. | Bal. | Bal. |
| Total | 100% | 100% | 100% | 100% | 100% | 100% | 100% | 100% |
| Test Evaluation 1 | Good | | | | Good | | | |
| Test Evaluation 2 | Excellent | | | | Excellent | | | |

TABLE 3

| | Example 5 | | | | Example 6 | | | |
|---|---|---|---|---|---|---|---|---|
| | BK | Y | M | C | BK | Y | M | C |
| Food Black 2 | 4% | | | | 4% | | | |
| Direct Black 168 | | | | | | | | |
| Self-dispersing carbon black (terminal carboxyl groups) | | | | | | | | |
| Acid Yellow 23 | | 1% | | | | 1% | | |
| Direct Yellow 86 | | | | | | | | |
| Acid Red 52 | | | 1% | | | | 1% | |
| Direct Red 227 | | | | | | | | |
| Acid Blue 9 | | | | 1.5% | | | | 1.5% |
| Direct Blue 199 | | | | | | | | |
| Diethylene glycol | 20% | | | | 20% | | | |
| Glycerine | | 25% | 25% | 25% | | 25% | 25% | 25% |
| 1,5-Pentanediol | | | | | | | | |
| Polyethylene glycol (molecular weight: 200) | | | | | | | | |
| Diethylene glycol monobutyl ether | | | | | | | | |
| Barium hydroxide | 0.5% | | | | | 0.8% | 0.8% | 0.8% |
| Barium hydroxide octahydrate | | | | | | | | |
| Ammonium chloride | | | | | 0.5% | | | |
| Ammonium nitrate | | | | | | | | |
| Ammonium thio-cyanate | | 0.45% | 0.45% | 0.45% | | | | |
| Purified water | Bal. | Bal. | Bal. | Bal. | Bal. | Bal. | Bal. | Bal. |
| Total | 100% | 100% | 100% | 100% | 100% | 100% | 100% | 100% |
| Test Evaluation 1 | Good | | | | Good | | | |
| Test Evaluation 2 | Excellent | | | | Excellent | | | |

TABLE 4

| | Example 7 | | | | Example 8 | | | |
|---|---|---|---|---|---|---|---|---|
| | BK | Y | M | C | BK | Y | M | C |
| Food Black 2 | | | | | | | | |
| Direct Black 168 | 5% | | | | | | | |
| Self-dispersing carbon black (terminal carboxyl groups) | | | | | 5% | | | |
| Acid Yellow 23 | | | | | | | | |
| Direct Yellow 86 | | 2% | | | | 2% | | |
| Acid Red 52 | | | | | | | | |
| Direct Red 227 | | | 2% | | | | 2% | |
| Acid Blue 9 | | | | | | | | |
| Direct Blue 199 | | | | 2% | | | | |
| Diethylene glycol | | | | | | | | 2% |
| Glycerine | | | | | 15% | | | |
| 1,5-Pentanediol | 10% | | | | | | | |
| Polyethylene glycol (molecular weight: 200) | | 20% | 20% | 20% | | 20% | 20% | 20% |
| Diethylene glycol monobutyl ether | | | | | | | | |
| Barium hydroxide | 0.25% | | | | | | | |
| Barium hydroxide octahydrate | | | | | 0.5% | | | |
| Ammonium chloride | | 0.1% | 0.1% | | | 0.1% | 0.1% | |
| Ammonium nitrate | | 0.1% | | 0.1% | | 0.1% | | 0.1% |
| Ammonium thio-cyanate | | | 0.1% | 0.1% | | | 0.1% | 0.1% |
| Purified water | Bal. | Bal. | Bal. | Bal. | Bal. | Bal. | Bal. | Bal. |
| Total | 100% | 100% | 100% | 100% | 100% | 100% | 100% | 100% |
| Test Evaluation 1 | | Good | | | | Good | | |
| Test Evaluation 2 | | Excellent | | | | Excellent | | |

TABLE 5

| | Comparative Example 1 | | Comparative Example 2 | | | |
|---|---|---|---|---|---|---|
| | BK | Y | BK | Y | M | C |
| Food Black 2 | 4% | | 4% | | | |
| Direct Black 168 | | | | | | |
| Self-dispersing carbon black (terminal carboxyl groups) | | | | | | |
| Acid Yellow 23 | | 1% | | 1% | | |
| Direct Yellow 86 | | | | | | |
| Acid Red 52 | | | | | 1% | |
| Direct Red 227 | | | | | | |
| Acid Blue 9 | | | | | | 1.5% |
| Direct Blue 199 | | | | | | |
| Diethylene glycol | 20% | | 20% | | | |
| Glycerine | | 20% | | 20% | 20% | 20% |
| 1,5-Pentanediol | | | | | | |
| Polyethylene glycol (molecular weight: 200) | | | | | | |
| Diethylene glycol monobutyl ether | | | | | | |
| Barium hydroxide | 5% | | 0.5% | | | |
| Barium hydroxide octahydrate | | | | | | |
| Ammonium chloride | | | | | | |
| Ammonium nitrate | | | | | | |
| Ammonium thiocyanate | | | | | | |
| Purified water | Bal. | Bal. | Bal. | Bal. | Bal. | Bal. |
| Total | 100% | 100% | 100% | 100% | 100% | 100% |
| Test Evaluation 1 | Good | | | Good | | |
| Test Evaluation 2 | Defective | | | Defective | | |

TABLE 6

| | Comparative Example 3 | | | | Comparative Example 4 | | | |
|---|---|---|---|---|---|---|---|---|
| | BK | Y | M | C | BK | Y | M | C |
| Food Black 2 | 4% | | | | 4% | | | |
| Direct Black 168 | | | | | | | | |
| Self-dispersing carbon black (terminal carboxyl groups) | | | | | | | | |
| Acid Yellow 23 | | 1% | | | | 1% | | |
| Direct Yellow 86 | | | | | | | | |

TABLE 6-continued

| | Comparative Example 3 | | | | Comparative Example 4 | | | |
|---|---|---|---|---|---|---|---|---|
| | BK | Y | M | C | BK | Y | M | C |
| Acid Red 52 | | | 1% | | | | 1% | |
| Direct Red 227 | | | | | | | | |
| Acid Blue 9 | | | | 1.5% | | | | 1.5% |
| Direct Blue 199 | | | | | | | | |
| Diethylene glycol | 20% | | | | 15% | | | |
| Glycerine | | 20% | 20% | 20% | | 20% | 20% | 20% |
| 1,5-Pentanediol | | | | | | | | |
| Polyethylene glycol (molecular weight: 200) | | | | | | | | |
| Diethylene glycol monobutyl ether | | 5% | 5% | 5% | 5% | 5% | 5% | 5% |
| Barium hydroxide | | | | | | | | |
| Barium hydroxide octahydrate | | | | | | | | |
| Ammonium chloride | 0.5% | | | | | | | |
| Ammonium nitrate | | | | | | | | |
| Ammonium thio-cyanate | | | | | | | | |
| Purified water | Bal. | Bal. | Bal. | Bal. | Bal. | Bal. | Bal. | Bal. |
| Total | 100% | 100% | 100% | 100% | 100% | 100% | 100% | 100% |
| Test Evaluation 1 | Good | | | | Good | | | |
| Test Evaluation 2 | Defective | | | | Relatively Defective | | | |

TABLE 7

| | Example 9 | | | |
|---|---|---|---|---|
| | BK | Y | M | C |
| Food Black 2 | 4% | | | |
| Direct Black 168 | | | | |
| Self-dispersing carbon black (terminal carboxyl groups) | | | | |
| Acid Yellow 23 | | 1% | | |
| Direct Yellow 86 | | | | |
| Acid Red 52 | | | 1% | |
| Direct Red 227 | | | | |
| Acid Blue 9 | | | | 1.5% |
| Direct Blue 199 | | | | |
| Diethylene glycol | 20% | | | |
| Glycerine | | 15% | 15% | 15% |
| 1,5-Pentanediol | | | | |
| Polyethylene glycol (molecular weight: 200) | | | | |
| Diethylene glycol monobutyl ether | | | | |
| Barium hydroxide | 0.5% | | | |
| Barium hydroxide octahydrate | | | | |
| Ammonium chloride | | 12% | 12% | 12% |
| Ammonium nitrate | | | | |
| Ammonium thiocyanate | | | | |
| Purified water | Bal. | Bal. | Bal. | Bal. |
| Total | 100% | 100% | 100% | 100% |
| Test Evaluation 1 | Defective | | | |
| Test Evaluation 2 | Good | | | |

Thus, the working examples of the present invention can afford adequate spraying stability and are highly effective in terms of bleeding prevention. By contrast, the comparative examples had drawbacks in one of these test evaluations.

The above description demonstrates that the ink-jet water-based ink set of the present invention can be sprayed in a stable manner, is highly effective in terms of bleeding prevention, and can provide excellent recording results when used as an ink-jet water-based ink in a variety of systems.

An embodiment of an ink cartridge is shown in FIG. 1. The ink cartridge 22 has four compartments 22*b*, 22*c*, 22*m*, 22*y* which contain the black ink, cyan ink, magenta ink and yellow ink as prepared in the above examples, respectively. The compartment 22*b*, 22*c*, 22*m*, 22*y* may be formed integrally or independently. The ink cartridge 22 is removably installed on an ink jet head 18. The ink jet head 18 has nozzle heads 21*b*, 21*c*, 21*m*, 21*y* which communicate with the compartment 22*b*, 22*c*, 22*m*, 22*y* to eject the black ink, cyan ink, magenta ink and yellow ink, respectively. A plurality of nozzles 24 are formed on the surface 23 of each nozzle head. The ink jet head is typically mounted on a carriage 17 which moves on and along a surface of a recording sheet.

What is claimed is:

1. An ink-jet water-based ink set used for an ink jetting recording apparatus, comprising:

a first ink containing water, a first coloring agent and a first component; and a second ink containing water, a second coloring agent and a second component which causes an endothermic reaction when in contact with the first component.

2. The ink-jet water-based ink set according to claim 1, wherein the first component is barium hydroxide and the second component is an ammonium salt.

3. The ink-jet water-based ink set according to claim 2, wherein the ammonium salt is at least one salt selected from a group consisting of ammonium chloride, ammonium nitrate, and ammonium thiocyanate.

4. The ink-jet water-based ink set according to claim 2, wherein ammonium hydroxide is produced by the reaction of the barium hydroxide and the ammonium salt.

5. The ink-jet water-based ink set according to claim 1, wherein the first coloring agent is a black coloring agent and the second coloring agent is a yellow coloring agent.

6. The ink-jet water-based ink set according to claim 5, further comprising third and fourth inks each of which includes a component which causes an endothermic reaction when in contact with the first component.

7. The ink-jet water-based ink set according to claim 6, wherein the third ink contains a magenta coloring agent, and the fourth ink contains a cyan coloring agent.

8. The ink-jet water-based ink set according to claim 1, wherein a solid deposit is formed upon the endothermic reaction of the first component with the second component.

9. The ink-jet water-based ink set according to claim 1, wherein the first ink contains 0.01–10 wt % of the first component and the second ink contains 0.01–10 wt % of the second component.

10. The ink-jet water-based ink set according to claim 1, wherein the water is deionized water.

11. An ink cartridge used for an ink jetting recording apparatus, comprising:

a first compartment accommodating a first ink which contains water, a first coloring agent and a first component; and a second compartment accommodating a second ink which contains water, a second coloring agent and a second component which causes an endothermic reaction when in contact with the first component.

12. The ink cartridge according to claim 11, wherein the first component is barium hydroxide and the second component is an ammonium salt.

13. The ink cartridge according to claim 12, wherein the ammonium salt is at least one salt selected from a group consisting of ammonium chloride, ammonium nitrate, and ammonium thiocyanate.

14. The ink cartridge according to claim 11, wherein the first coloring agent is a black coloring agent and the second coloring agent is a yellow coloring agent.

15. The ink cartridge according to claim 14, further comprising a third compartment containing magenta coloring agent and a fourth compartment containing cyan coloring agent.

16. An ink-jet recording method for recording images by ejecting an ink-jet water-based ink set onto a recording medium, comprising:

ejecting a first ink containing water, a first coloring agent and a first component onto the recording medium; and ejecting a second ink containing water, a second coloring agent and a second component onto the recording medium, the second component causing an endothermic reaction when in contact with the first component.

17. The ink-jet recording method according to claim 16, wherein the first component is barium hydroxide and the second component is an ammonium salt.

18. The ink-jet recording method according to claim 17, wherein the ammonium salt is at least one salt selected from a group consisting of ammonium chloride, ammonium nitrate, and ammonium thiocyanate.

19. The ink-jet recording method according to claim 16, wherein the first coloring agent is a black coloring agent and the second coloring agent is a yellow coloring agent.

20. The ink-jet recording method according to claim 16, further comprising ejecting a third ink containing magenta coloring agent onto the recording medium and ejecting a fourth ink containing cyan coloring agent onto the recording medium.

* * * * *